United States Patent [19]

Scholl et al.

[11] 4,175,681

[45] Nov. 27, 1979

[54] APPARATUS FOR MARKING AND TRIMMING COLLARS

[75] Inventors: Hans Scholl, Oerlinghausen-Lipperreihe; Helmut Tiemann, Bielefeld, both of Fed. Rep. of Germany

[73] Assignee: Koch Adler AG, Bielfeld, Fed. Rep. of Germany

[21] Appl. No.: 837,564

[22] Filed: Sep. 28, 1977

Related U.S. Application Data

[63] Continuation-in-part of Ser. No. 622,734, Oct. 15, 1975, abandoned.

[51] Int. Cl.[2] ..... A41H 9/00

[52] U.S. Cl. ..... 223/2; 83/33; 83/901

[58] Field of Search ..... 223/1, 2, 3, 4, 52, 223/52.1, 1.1; 83/33, 901

[56] References Cited

U.S. PATENT DOCUMENTS

| | | | |
|---|---|---|---|
| 1,170,492 | 2/1916 | Roby | 223/2 |
| 2,150,016 | 3/1939 | Wood | 83/33 X |
| 2,268,856 | 1/1942 | Cummings | 83/33 X |
| 2,742,204 | 4/1956 | Kruglick | 223/1 |
| 2,909,307 | 10/1959 | Hunt et al. | 223/2 |
| 3,191,557 | 6/1965 | Moore | 223/2 X |
| 3,482,743 | 12/1969 | Saltiel | 223/1 |
| 3,779,185 | 12/1973 | Sakakura et al. | 223/2 X |
| 4,068,783 | 1/1978 | Maier | 223/1.1 |

*Primary Examiner*—Louis Rimrodt
*Attorney, Agent, or Firm*—Jacob L. Kollin

[57] ABSTRACT

An apparatus for use in producing men's shirts or blouses provided with attached collars, which have a bottom fabric layer with a joining edge and a top fabric layer. The apparatus is provided with a marking device for indicating the collars at several points before sewing on the shirts or blouses and with a cutting device for trimming the joining edge of the bottom fabric layer of a collar after indicating. The marking device is provided with means for adjusting to variable collar sizes and changing over to different collar contours and the cutting device containing means for feeding the collars during trimming and for guiding the collars along the cutting means arranged side by side on a base plate. By this it is possible to perform two working operations by only one operator.

16 Claims, 15 Drawing Figures

25
26
27
28
29
110
111
166
181
158
158b
179
176
178
180
95
88
87
S1
S2
S3
A
B
C
N
E
¼ L

APPARATUS FOR MARKING AND TRIMMING COLLARS

This application is a continuation-in-part of application Ser. No. 622,734 filed Oct. 15, 1975, now abandoned.

BACKGROUND OF THE INVENTION

The invention relates to an apparatus for use in producing of men's shirts or blouses which are provided with attached collars having a bottom fabric layer with a joining edge and a top fabric layer.

When producing men's shirts, the collars are usually marked in order to facilitate the application of a collar to the shirt body. Marking is accomplished at the joining edge of the collar bottom part and the edge of the collar top part folded about a lining, at the collar center and at those points, which afterwards have to register with the shoulder seams ending in the neck opening of the shirt body.

These three marks must always be applied evenly distributed over the width of the collar independently of the collar shape or size.

There are already known devices, which are adapted for marking as described above. These known devices mark the joining edge of the collar bottom part and the folded edge of the collar top part by means of needles which form holes, respectively, by means of a knife, which cuts small slots into said edges. Furthermore, there are known marking devices provided with electromagnetically heated filaments, which mark the joining edge by means of brands and simultaneously the folded edge of the collar top part by means of drawing pencils.

When using the aforesaid devices the collar to be marked first needs to be folded in its center in such a manner, that the corners and neck band ends register together. Then, the collar is positioned with its folded section against a stop, which is displaceably secured to the device and adjustable according to the various collar sizes to be handled. Subsequently, the marking tools are lowered upon the collar by actuating a pedal.

Moreover, when using the aforesaid devices, the operator has to see to it, that, prior to the insertion of a collar, the stop has been adjusted according to the collar size to be marked. By using these devices, especially when handling collars of different sizes in series, it is possible, that collars with incorrectly applied marks will get into the following working cycle and greatly disturb the machine's proper operation, if the operator works careless.

Since too wide or unequally wide joining edges complicate the sewing on of the collar and may lead to an incorrect seam of the neck opening, the joining edge of collar bottom part needs to be trimmed, which is accomplished either prior to or after marking at a second working station. For trimming there is commonly used a sewing machine formed with a trimming device. Moreover, such a machine is provided with a guide stop determining the width of the joining edge. Guiding of the collar while being trimmed is performed manually.

It is an object of this invention to provide an apparatus for marking and trimming collars in such a manner that the amount of labor for preparation of the collars to be sewn on to the shirt body will be reduced and that all required operations may be performed by one operator at a single working station in an overlapping manner.

It is a further object of the invention to provide a marking device with automatically acting means for adjusting the marking tools to variable collar sizes and different contours.

It is also an object of the invention to provide the cutting device with automatically acting means for feeding and guiding the collars along the cutting means.

Further objects and advantages of the invention will become apparent from the following description with particular reference to the accompanying drawings.

Figures 1, 10:
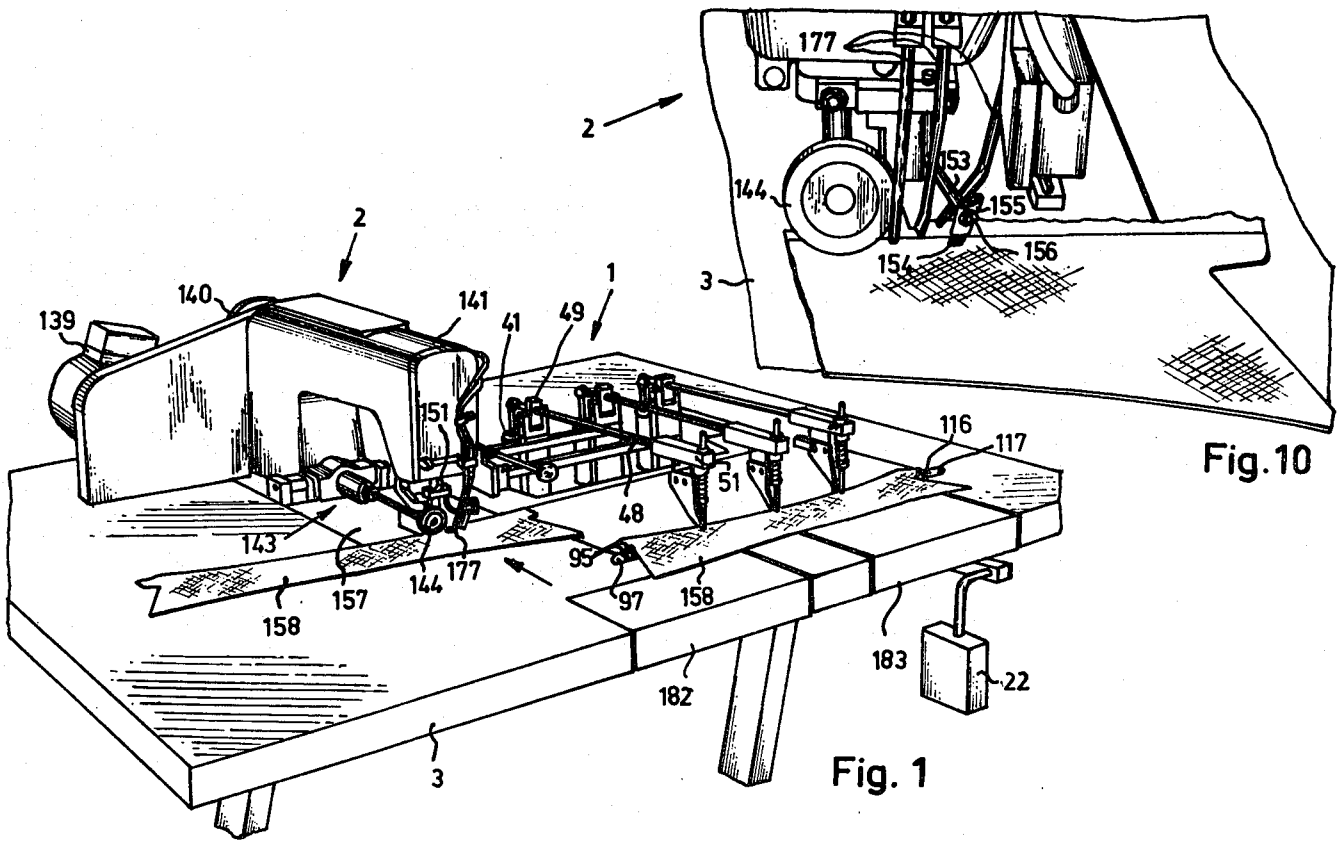
FIG. 1 is a perspective front view of the apparatus comprising a marking device and a trimming device arranged on a common base plate.
FIG. 10 is a perspective partial view of the feeding and guiding means of the trimming device and of a collar located in said device.

As obvious from FIG. 1 the apparatus comprises a marking device 1 and a cutting device 2 arranged on a common base plate 3.

The marking device 1 (FIGS. 2 to 4) is provided with two lateral bearings 4, 5 for securing it below the base plate 3. Between the lateral bearings 4, 5 are inserted two supporting rods 6, 7, on which bearing members 8, 9, 10 11 are displacably supported. The bearing members 8 to 10 are provided with a lower plate 12 and an upper plate 13 secured by means of screws 14 to bushings 15. The bushings are displaceably supported on the supporting rod 7. Between the plates 12, 13 is located a spacing piece 16 serving for lateral adjustment of a further bushing 17, which is displacably supported on the supporting rod 6. The bushing 17 is displacable by a small amount in a plane extending vertically to the supporting rod 6, but not pivoted, in order to balance discrepancies with regard to the parallelism of the two supporting rods 6, 7.

Figure 2:
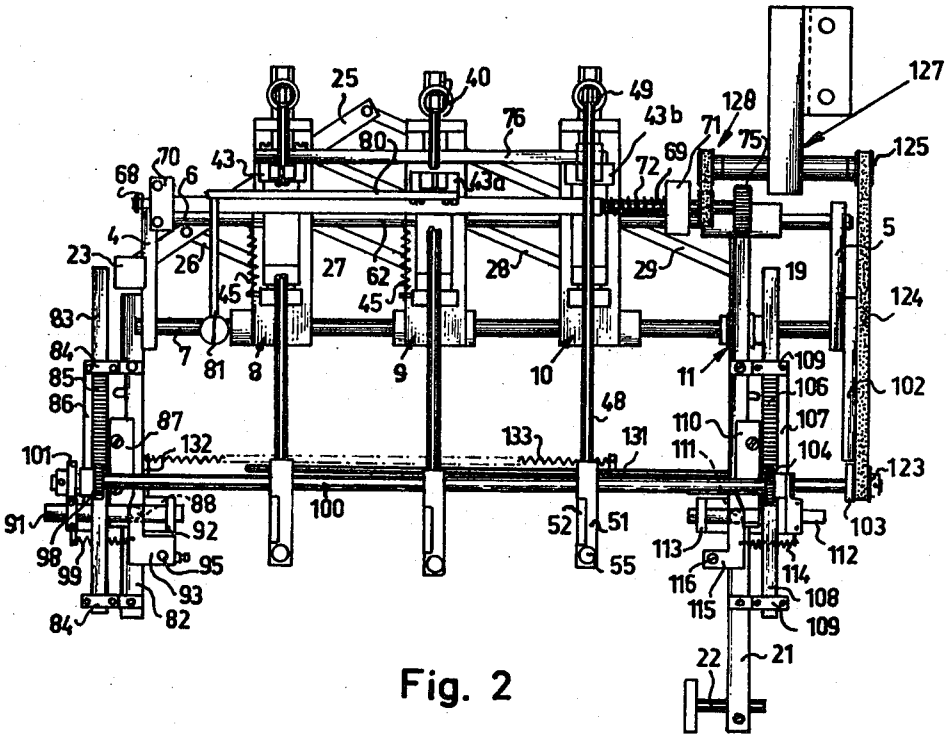
FIG. 2 is a top plan view of the marking device, at which the base plate is removed.
Figures 4, 8:
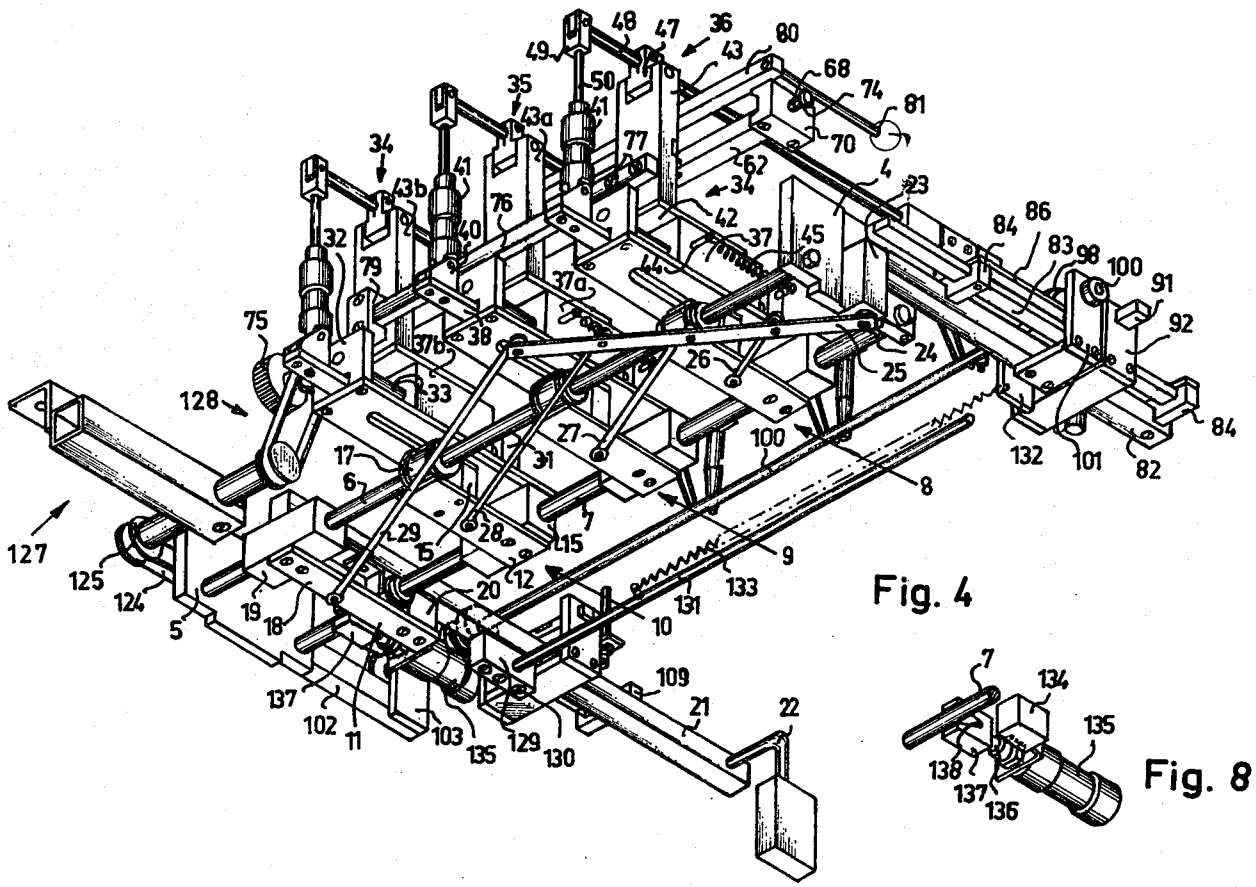
FIG. 4 is a perspective bottom view of the marking device without base plate.
FIG. 8 is a partial view of FIG. 4 showing the clamping device cooperating with a supporting rod.

The bearing member 11 having also a lower plate 18, a bushing 19, a spacing piece 20 and a bushing 17, carries a rod 21, the free end of which is provided with a toggle lever (FIGS. 1, 2, 4).

Secured to the lateral bearing 4 is a block 23 carrying a pivot pin 24 about which is pivoted a lover 25. To the lever 25 are articulated connecting links 26 to 29 evenly spaced from the point of rotation and amoung one another. The connecting links 26 to 29 are extending in parallel with each other and the different lengths of which are determined by the fact, that their free ends are hinged to the lower plates 12 and 18 of the bearing members 8 to 11 in such a manner, that their hinges and the pivot pin 24 for the lever 25 lie on a straight line in parallel with the supporting rods 6, 7.

On the upper plates 13 of the bearing members 8 to 10 there are located two bearing blocks 31, 32 (FIGS. 3 and 4) for receiving a cylindrical rod 33, to which are displaceably arranged supports 34 comprising a block 37, **37*a*, 37*b* received by the cylindrical rod 33, a bar 38 secured to the rod 33 and projecting through a recess 39 which is formed in the block 32 and carrying a swivel bearing 40 for receiving a compressed air cylinder 41, a plate 42 and a bearing plate 43 resp. 43*a*, 43*b* secured to the plate 42 and extending upwardly. The blocks 37 and 37*a* are provided with pins 44 for receiving one end of a tension spring 45, while the other end is supported by a pin 46 inserted in the bearing block 31. At their inner forked portion the bearing plates 43, 43*a*, 43*b* carry a swingably supported clamping piece 47, in which a rod 48 is received. To one arm of the rod 48 is hinged by means of a forked member 49 a piston rod 50 of the compressed air cylinder 41. At the free end of the rod 48 is located a receiving member 51 (FIGS. 1, 2 and 5) receiving an electrically heatable marking iron 52 and a pencil lead holder 55 which is displaceably supported in a bushing guide 53 against the tension of a spring 54. The lead 56 is clamped in the holder 55** by means of clamping jaws.

Figures 5, 6, 7:
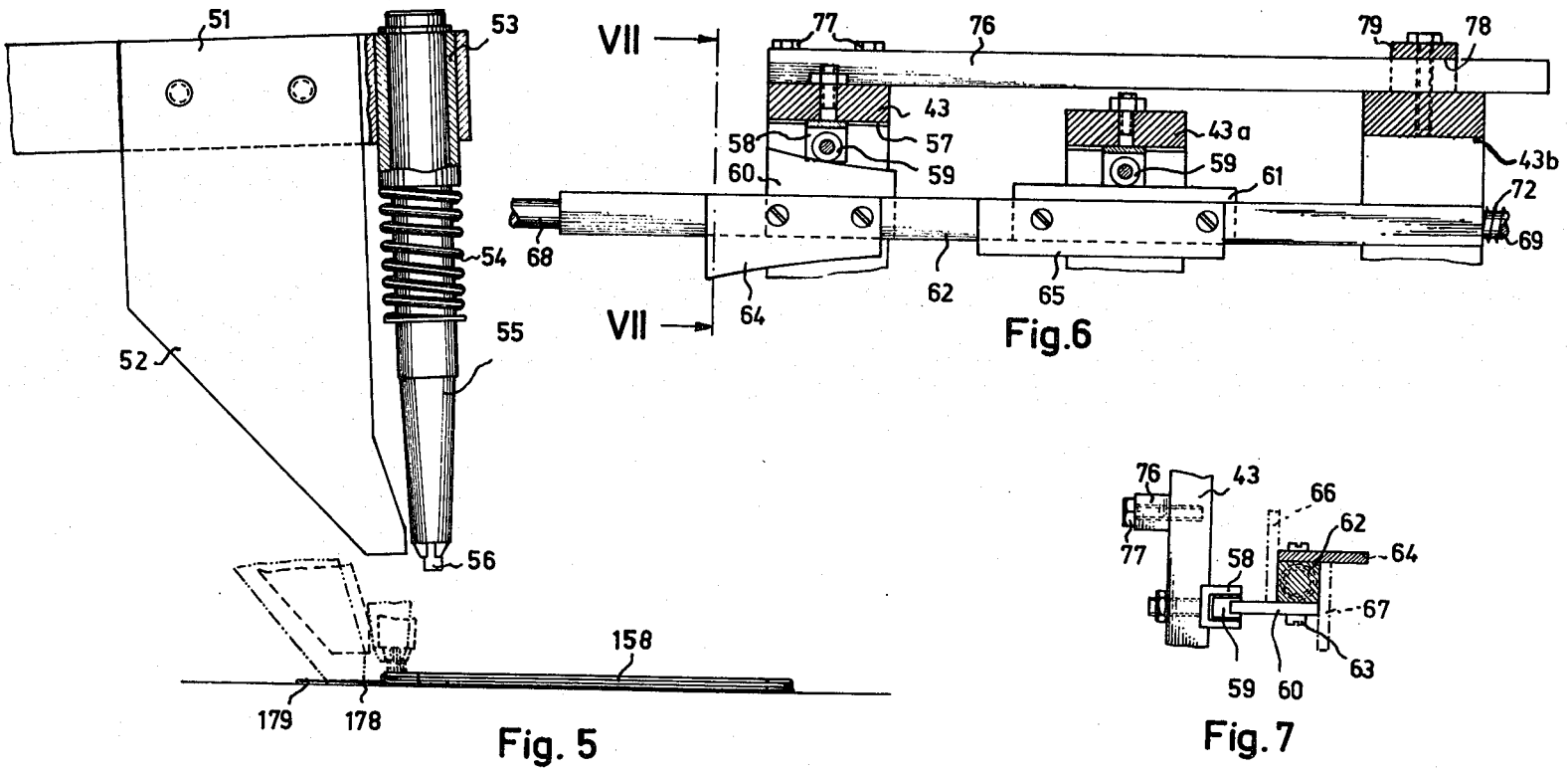
FIG. 5 is a side elevation of one of the marking tools, partly in section.
FIG. 6 is a top plan view of the rotatable cam carrier and the striker bars in operation connection with bearing plates.
FIG. 7 is a section taken along line VII—VII of FIG. 6.

In a recess 57 (FIGS. 3, 6 and 7) formed in the bearing plates 43, **43*a* there is provided a forked piece 58, in which is pivoted a roller 59. Said rollers 59 only provided at the bearing plates 43, 43*a*, are bearing under the tension of the tension springs 45 against striker bars 60, 61, which are secured to a cam carrier 62 by means of screws 63. Arranged at the cam carrier 62 having a quadrangular cross section, are striker bars 64, 65, resp. as indicated in FIG. 7 by dot-dash lines, striker bars 66, 67**.

The cam carrier 62, the ends 68, 69 of which are formed as shafts, is rotatable in bearings 70, 71 and axially displaceable against the tension of a spring 72. As obvious from FIG. 3, the bearing 70 is formed with a groove 73, so that the cam carrier 62 can enter with its quadrangular portion under the tension of spring 72, in order to keep the striker bars 60, 61 in working position. A guard ring 74 located at the shaft end 68, prevents the latter from being drawn out of the bearing 70. Secured to free shaft end 69 is a hand wheel 75. Secured to the bearing plate 43 by means of screws 77 (FIGS. 2, 4 and 6) is a groove stem 76, the free end of which is slidably received in a correspondent recess 78 formed in a guiding piece 74 which is located at the bearing plate **43*b*. Secured to the bearing plate 43*a* (FIGS. 2 and 4) is a lever 80 carrying at its end a ball handle 81**.

Screwed to the lateral bearing 4 (FIGS. 2, 3, 4) is a supporting rod 82, to which is arranged and received in guides 84 a shifting bar 83 carrying a cam carrier 86, said cam carrier being formed with a toothing 85 and serving for receiving an exchangeable cam 87. Bearing against the cam contour is a loose roller 88 which is secured by means of a lug 89 and a nut 90 to a shifting member 91. The shifting member 91 is received in an U-shaped bearing member 92 and vertically displacable with regard to the supporting rod 82. Moreover, secured to the shifting member 91 is an angle plate 93 carrying a small compressed air cylinder 94, the piston rod 96 of which is provided with a stop bolt 95, which, if the compressed air cylinder 94 is pressurized, can enter into an oblong hole 97 located in the base plate 3 (FIG. 1). Between the angle plate 93 and the U-shaped bearing member 92 is suspended a tension spring 99 pressing the roller 88 against the cam 87.

Meshing with the toothing 85 of the cam carrier 86 is a toothed wheel 98 fixed to a shaft 100, which is pivoted in a bearing bracket 101 screwed to the supporting rod 82 and in a bearing bracket 103 secured to a supporting rod 102. Displacably supported on a slide spring 105 located in the shaft 100 is another toothed wheel 104 meshing with the toothing of a cam carrier 107. The latter is located on a shifting bar 108 slidably supported in guides 109 along the rod 21, and serves for receiving a cam 110 (FIGS. 2 and 3) the contour of which is adapted to move a shifting member 112 by means of a loose roller 111. The shifting member 112 is supported in an U-shaped bearing portion 113 under the tension of a spring 114 and carries a plate 115. An stop bolt 116 inserted into the plate 115 projects through an oblong hole 117 formed in the base plate 3 (FIG. 1).

The tooth wheel 104 is formed at its hub 118 with a radial groove 119 (FIG. 3) into which engages a finger 120 of an adapting piece 122 secured to the side wall 121 of the bearing member 113, so that the toothed wheel 104 is moved on the shaft 100 after the rod 21 has been actuated.

Fitted to the end of the shaft 100 received by the bearing bracket 103, is a toothed belt pulley 123 (FIGS. 2 and 3) connected by means of a toothed belt 124 and a toothed belt pulley 125 to an intermediate shaft 126, which, for the purpose of retighten the belt 124, is pivoted to a bearing 127 swingably supported at the bottom surface of the base plate 3. The intermediate shaft 126 is connected by means of a further toothed belt connection 128 (FIGS. 2 and 4) to the shaft end 69 of the cam carrier 62.

Figure 3:
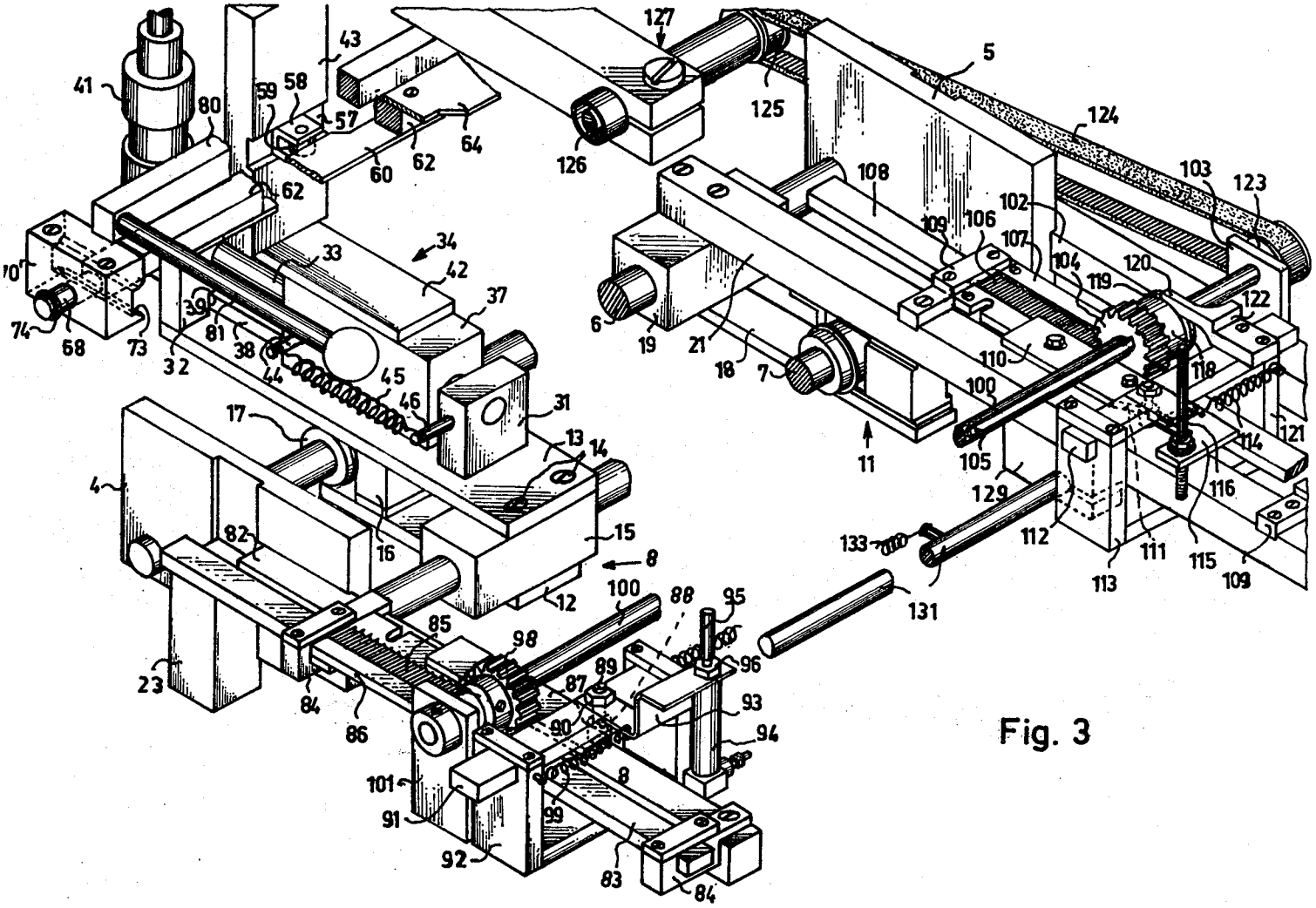
FIG. 3 is a perspective view, partly in section, of the moving parts of the marking device, in which the base plate is also removed.

As obvious from FIGS. 3 and 4, a clamping piece 129 is secured to the rod 21 for receiving a movable striker bar 131, clampable by means of a screw 130 and cooperating with a stop plate 132, which is secured to the supporting rod 82. Between the stop plate 132 and the striker bar 131 is located a tension spring 133.

Attached to the rod 21 by means of a mounting support 134 (FIG. 8) is a compressed air cylinder 135, the piston rod 136 of which is provided with a clamping piece 137 formed with a V-shaped recess 138 which, if the compressed air cylinder 135 is pressurised, is pressed against the supporting rod 7.

The trimming device 2 illustrated in FIGS. 1 and 9 to 13, comprises a conventional sewing machine at which, however, the stitch forming tools have been removed.

The trimming device 2 is driven by a motor 139 (FIG. 1) driving by means of a driving wheel 140 an armshaft 142 pivoted in the housing 141, and a not further shown feeding device 143 having an intermittently operating feed roller 144. The up and down motions of the cutting knife 145 cooperating with a not further shown counterknife, are performed by means of an eccentric 146 located on the armshaft 141, via a lever 147, a double lever 149 pivoted about an axis 148, a connecting lever 150 and a block 151, to which is secured the knife 145 and which is displacably supported on a rod 152.

In the block 151 there is supported and clamped an angularly bent rod 153 displacable in parallel with the rod 152 located in the housing 141. To the lower front surface of the rod 153 is secured by means of stiffening plates 155 and a screw 156 a plate 154 (FIGS. 10 and 13) formed of an elastic material and extending angularly with regard to the workpiece supporting plate 157 of the machine. The end of the plate 154 projecting from the stiffening plates, cooperates with the collar 158 positioned on the workpiece supporting plate 157.

On the workpiece supporting plate 157, immediately in front of the cutting knife 144, there is located an edge guiding 159 (FIGS. 9, 11 and 12) comprising an angularly bent rod 160, one end of which is displacably secured to a clamping holder 161 by means of a screw 162, a clamping lever 163 located on the rod 160 and a swingable guiding member 164. The latter is formed as a double armed lever and swingably mounted by means of a countersunk screw 165 to a flattening 166 provided at the other end of the rod 160 (FIG. 12). One arm 167 of the double armed lever is under the tension of a spring 168 supported between two pins 169. The latter are inserted into the arm 164 and the rod 160. The guiding member 164 has a beveled edge 170 which bears under the tension of the spring 168 against a correspondingly formed edge 171 of the rod 160. Moreover, the guiding member 164 is provided with a nose 172 for abutting against the rod 160 and the purpose of limiting the angel of avertance of guiding member 164.

A recess 174 formed with bevelings 173, serves for guiding of that portion of the collar top piece 176 which is folded about a lining 175.

Figure 9:
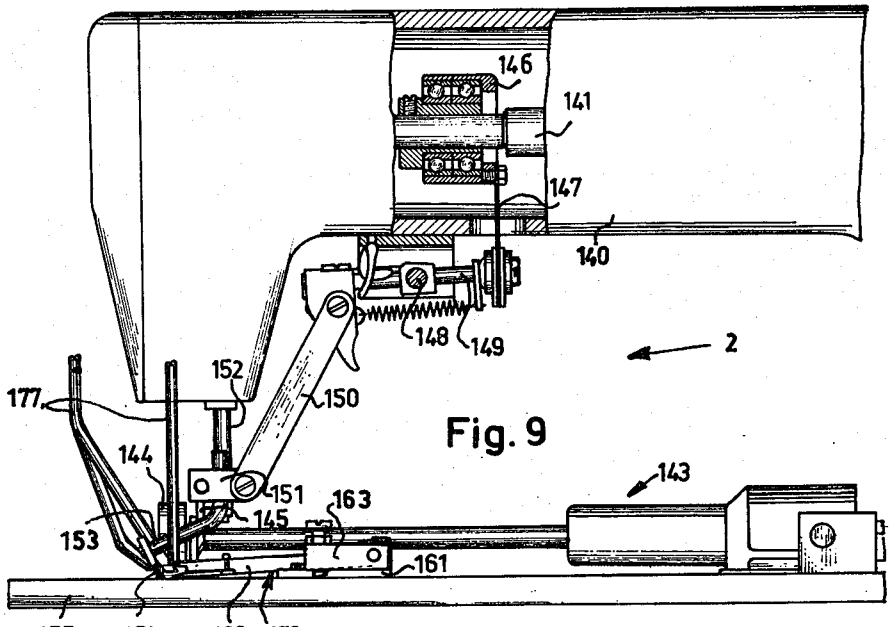
FIG. 9 is a partial side elevation of the trimming device.
Figures 14A, 14B:
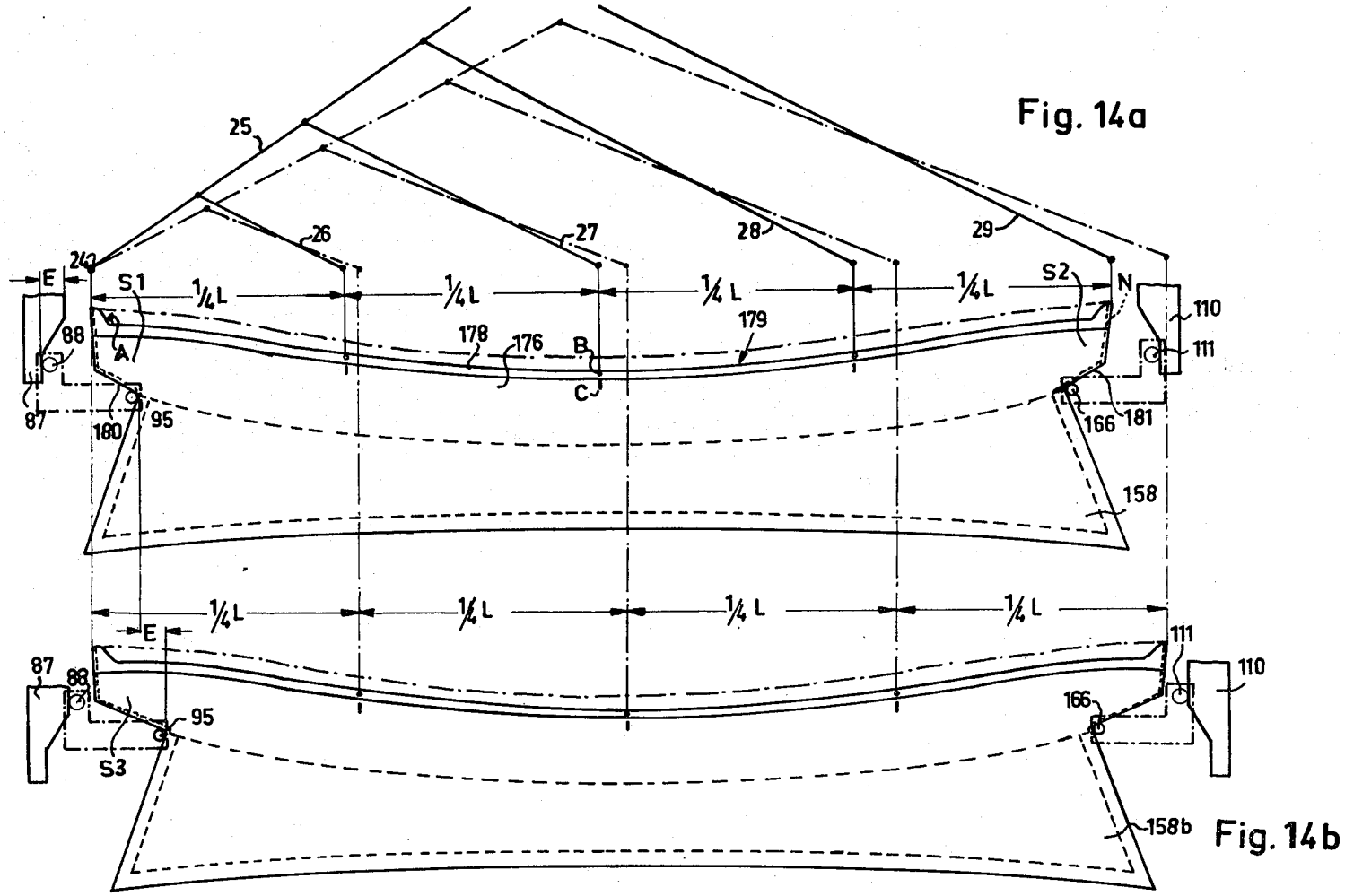
FIG. 14*a* is a top plan view of a collar having a relatively short neck band end, and showing the position of the stop bolts and the compound lever arrangement
FIG. 14*b* is a view according to FIG. 14*a* showing the stop bolts in another position for marking a collar of the same size but having an elongated neck-band end.

As is obvious from FIGS. 1, 9 and 10, the trimming device 2 is provided with air lines 177, serving for additionally guiding the collar 158 by means of air drafts which impinge upon the collar 158 from different directions. Operation of the apparatus can be described as follows:

The collars 158 and **158*b* illustrated in FIGS. 14*a* and 14*b*, will be marked successively at the joining edge 178 of the collar bottom piece 179 by means of brands B and simultaneously at those points of the collar top piece 158 designated with C. Subsequently, the joining edge 178 at the collar bottom piece 179** will be trimmed.

When displacing the rod 21 to the right by means of the toggle lever 22, the stop bolt 116 is moved as far as the collar 158 can be placed with its two inner corners located at the collar neck band ends 180, 181 between the two stop bolts 95 and 116 located on the base plate. In this position, the three marking irons 52 and the lead holders 55 are evenly distributed over the length of the collar 158 (¼ length each) by means of the compound lever system.

To avoid the burning of the operator's fingers, the marking device can be started only by using both hands for actuating the two flaps 182, 183 (FIG. 1), which causes the switching of two series connected, the switches (not shown) and by this the pressuration of the air cylinders 41, so that marking irons 52 and the leads 56 are lowered upon the collar 158 (FIG. 5 thus marking the joining edge 178 of the collar bottom piece 179 with brands B and the edge of the collar top piece 176 with colored marks C. The marking tools 52 and 56 are kept in their positions during this procedure by means of the pressurised compressed air cylinder 135 pressing the clamping member 137 (FIG. 8) against the supporting rod 7. Now, if the following collar to be marked are all of the same size, the marking device can be locked in this position by displacing of the striker bars 131 until bearing against the stop plate 132 (FIG. 4) or, by a not shown switch preventing the compressed air cylinder 135 from being pressurised. After lifting the marking tools 52, 56 the collar is moved to the rear and aside into the trimming device 2 until bearing against the feed roller 144 in such a manner, that the edge of the collar top piece 176 lies in the recess 174 of the edge guiding 159, while the joining edge 178 of the collar bottom piece 179 to be trimmed, lies planely on the workpiece supporting plate 157 below the swingable guiding member 164 (FIG. 12) and is glidable under the influence of an air draft.

After starting the cutting device 2, the first cut will be made at the point "A" designated in FIG. 7, so that at a short length the joining edge 178 of the collar will not be cut.

Figure 13:
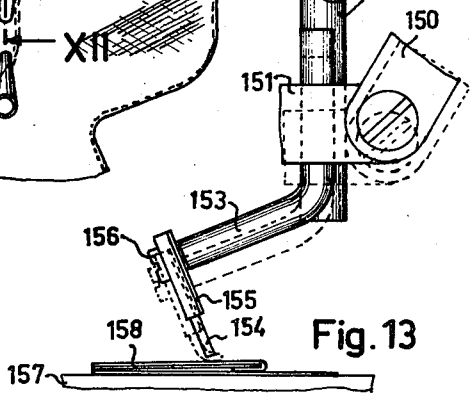
FIG. 13 is an enlarged illustration of the elastic plate moved up and down together with the cutting knife and acting upon the collar.

The collar 158 advanced by means of the feed roller 144, is now automatically guided by means of the elastic plate 154, which is moved up and down together with the cutting knife 145 and which, when impinging upon the collar as dot-lined in FIG. 13, is bent at its lower end, thus imparting the collar a lateral movement under the effect of the air drafts and preventing the collar from being removed out of the recess 174 formed in the edge guiding 159.

Figure 11:
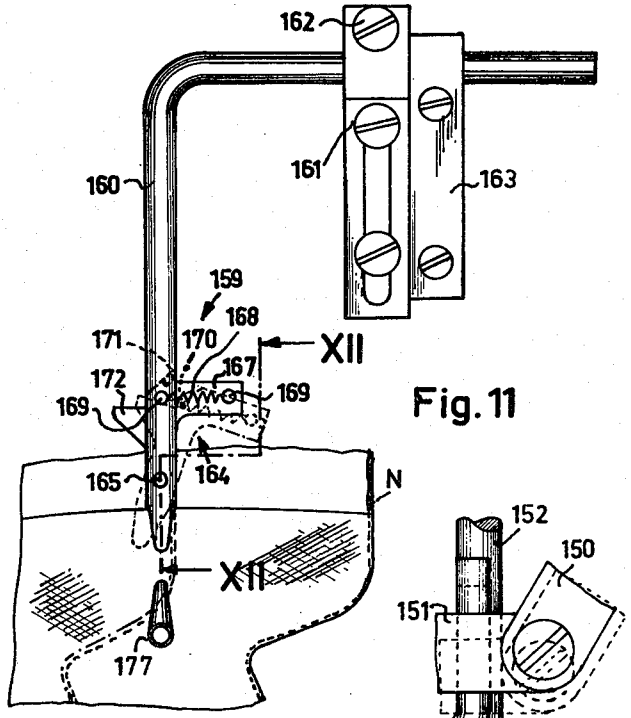
FIG. 11 is a top plan view of the edge guiding tool for the collar, disposed in the trimming device.
Figure 12:
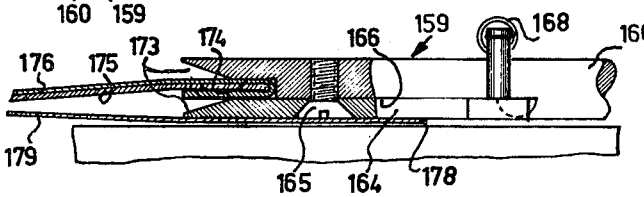
FIG. 12 is a section taken along line XII—XII of FIG. 11.

At the end of a working cycle, the neck band end 152 is bearing with its inner seam N against the guiding member 164, thus traversing the latter until its nose 172 rests against the striking edge 171 as dot-lined in FIG. 11. At this moment, the collar 158 is out of the effective range of the side thrust imparted by the plate 154, turns and slides off from the guiding member 164, so that the cutting knife 145 does not trim the joining edge up to the collar end but leaves behind an ear, said ear being folded inwardly when joining the collar to the shirt body, thus effecting the reliably back tacking of the joining seam N.

While trimming the collar 158 (FIG. **14*a*) the operator places another collar 158*b* (FIG. 14*b*) into the marking device 1**. This collar shows the same dimension between the corners of the neck band ends but the neck band ends have different lengths.

Changeover to the collar shape **158*b* is made in the usual manner, so that at first by means of the ball handle 81 (FIGS. 2 to 4) the bearing plate 43*a*, and, after bearing of the latter against the groove stem 76, also the two bearing plates 43 and 43*b* connected with one another, are removed from the striker bars 60, 61 against the tension of the springs 45. Then, by means of the handwheel 75 the cam carrier 62 is drawn against the tension of the springs 45. Then, by means of the handwheel 75 the cam carrier 62 is drawn against the tension of the spring 72 out of the groove 70 (FIG. 3) located in the bearing 78, and turned as far as the striker bars 64, 65 determined for the collar shape 168*b*, have arrived the effective range of the rollers 59 which are secured to the bearing plates 43 and 43*a***.

Due to the turning of the cam carrier 62, the cam carriers 86 and 107 and thus also the cams 87 and 110 have been moved by means of the toothed belt connection 128 (FIG. 2), toothed belt pulley 125, toothed belt 123, shaft 100, toothed wheels 98, 104 and toothings 85 and 106, which in turn was causing against the tension of springs 99 and 114 and the loose rollers 88 and 111 a movement of the stop bolts 95 and 166 by an amount E. If now, after movement of the marking device by means of the toggle lever 22 (FIGS. 2) the collar 158*b* is inserted into the device between the stop bolts 95, 166 (FIG. 14*b*), so the left edge of the neck band end is again lying on a straight line extending through the center of rotation 24 of the lever 25, thus obtaining an uniform and evenly distributed (¼ of the length each) localisation of the marking points.

The preceding description relates to a device which allows the marking of a collar at its joining edge prior to cutting, however, if the cutting device will be mounted on the right of the marking device it is obvious that the cutting process can be performed prior to the marking process.

We claim:

1. An auxiliary apparatus for the final operation of a sewn collar consisting of a bottom fabric layer with a joining edge and a top fabric layer, before sewing onto a shirt or blouse, comprising a base plate, marking means mounted on said base plate for marking a collar at a plurality of spots of the bottom fabric layer and at matching spots of the top fabric layer, said marking means including marking tools, means for adjusting said marking tools with respect to various collar sizes, and means on said plate for varying said marking tools for different collar contours, cutting means mounted on said base plate adjacent said marking means for trimming a joining edge of said bottom fabric layer of said collar after marking by said marking means, means for feeding a collar during trimming, and means for guiding a collar along said cutting means, said marking means, said trimming means and said guiding means being operable in timed relationship.

2. An auxiliary apparatus as claimed in claim 1, wherein said means for adjusting said marking tools with respect to various collar sizes comprise shifting means including a lever system carrying said marking tools, and means for causing the automatic and uniform distribution of said marking tools over the length of a collar inserted into said apparatus.

3. An auxiliary apparatus as claimed in claim 1, wherein each of said marking tools comprises an electrically energized branding iron for forming brands at the joining edge of the collar bottom layer, and a drawing pencil for simultaneously marking the collar top layer.

4. An auxiliary apparatus as claimed in claim 1, wherein said marking means include a lever system comprising a plurality of rods carrying said marking tools, bearing plates carrying said rods and connected with said means for adjusting said marking tools with respect to various collar sizes and said means for varying said marking tools for different collar contours, and means for pivoting said rods in said bearing plates, said cutting means, said feeding means and said guiding means being arranged on said base adjacent to said marking means in the path of motion of a collar after it has left said marking means.

5. An auxiliary apparatus as claimed in claim 4, wherein said marking means further include bearing members for slideably receiving said plates in the direction of said rods and linked to said lever system, supporting rods for movably carrying said bearing members, striker bars cooperating with said means for adjusting said marking tools with respect to various collar sizes, and a pair of cam means for controlling a pair of stop dogs connected with said means for varying said marking tools for different collar contours.

6. An apparatus as claimed in claim 5, wherein said lever system comprises a fixedly mounted pivot pin, a lever pivoted on said pivot pin, an adjusting rod movably supported on said supporting rods, one connecting link linked to the free end of said lever and said adjusting rod, and connecting links linked to said bearing members and said lever, the pivotal points of said one connecting link and said connecting links being uniformly distributed on said lever with reference to said pivot pin.

7. An apparatus as claimed in claim 5, wherein said marking means further include a base plate, two lateral bearing blocks secured to said base plate and receiving said supporting rods, and an adjusting rod movably supported on said supporting rods, and wherein one of said two stop dogs and one of said two cam means assigned to said one stop dog are carried by one of said two lateral bearing blocks and the other one of said stop dogs and the other one of said cam means assigned to said other stop dog are carried by said adjusting rod.

8. An apparatus as claimed in claim 7, wherein said marking means further include a striker bar carrier for receiving said striker bars, a hand wheel connected with said striker bar carrier for revolving said carrier, and gearing means between said striker bar carrier and said two cam means for adjusting said stop dogs.

9. An apparatus as claimed in claim 8, wherein said gearing means comprise cam carriers provided with gearings and carrying said two cam means for the lateral displacement of said two stop dogs, gear wheels meshing with said gearings of said cam carriers, a shaft carrying said gear wheels, and a motion mechanism between said shaft and said striker bar carrier connected with said hand wheel.

10. An apparatus as claimed in claim 9 further comprising a knee-actuated lever secured to said adjusting rod, a stop bar adjustably secured to said adjusting rod for limiting the shifting of said adjusting rod, and a spring for holding said adjusting rod in a normal position determined by said stop bar.

11. An apparatus as claimed in claim 9, wherein said shifting means consists of an angularly bent rod carried by said block slidably received on said vertical rod, a stiffening plate secured to the front surface of the free end of said angularly bent rod, and a plate of elastic material fastened in said stiffening plate for cooperating with said collars.

12. An apparatus as claimed in claim 1, wherein said cutting device comprises a housing having a workpiece supporting plate disposed adjacent said marking device, an arm shaft pivotally attached in said housing, a motor for driving said arm shaft, eccentric means secured to said arm shaft, a two-armed lever swingably received on an axis, a connecting means between said eccentric means and one arm of said two-armed lever, a vertical rod secured to said housing, a block slidably received on said vertical rod, a connecting lever linked to the other arm of said two-armed lever and said block, and a cutting blade fastened to said block.

13. An apparatus as claimed in claim 1, wherein said cutting means includes a housing having a workpiece supporting plate disposed adjacent said marking device, a vertical rod secured to said housing, a block slidably received on said vertical rod, a cutting blade fastened to said block, and driving means for imparting up and down motions to said block, and said means for feeding said collars during trimming comprises a driven feed roller arranged behind said cutting means.

14. An apparatus as claimed in claim 13 wherein said cutting device includes a housing having a workpiece supporting plate, a vertical rod secured to said housing, a block slidably received on said vertical rod, a cutting blade secured to said block, and driving means for imparting up and down motions to said block, and said means for guiding said collars along said cutting means comprises an edge guiding arranged in front of said cutting means and shifting means intermittently acting upon said collars in order to cause lateral deflection of said collar in the direction to said edge guiding.

15. An apparatus as claimed in claim 14, wherein said means for guiding said collars further comprises air nozzles in order to blow air streams against said collars in different directions.

16. An apparatus as claimed in claim 15, wherein said edge guiding includes a rod having an angle-shaped form and provided with a flattening, a recess and a beveling at one end of said rod, a guiding member swingably secured to said flattening of said rod and provided with a beveling, a spring between said guiding member and said rod for holding said guiding member in a normal position, and means for displaceably mounting said rod in said apparatus.

* * * * *